United States Patent [19]

Lenk et al.

[11] 4,180,717

[45] Dec. 25, 1979

[54] INDUCTIVELY HEATABLE GODET WITH INSULATING MEANS

[75] Inventors: Erich Lenk; Karl Bauer, both of Remscheid, Fed. Rep. of Germany

[73] Assignee: Barmag Barmer Maschinenfabrik AG, Remscheid-Lennep, Fed. Rep. of Germany

[21] Appl. No.: 842,521

[22] Filed: Oct. 17, 1977

[30] Foreign Application Priority Data

Oct. 21, 1976 [DE] Fed. Rep. of Germany ..... 2647540

[51] Int. Cl.[2] ..... H05B 5/08

[52] U.S. Cl. ..... 219/10.49 A; 219/10.61 A; 336/197

[58] Field of Search ..... 219/10.49 R, 10.49 A, 219/10.61 R, 10.61 A, 10.79, 10.75, 469, 470, 471; 336/60, 196, 197, 198, 233, 100, 210

[56] References Cited

U.S. PATENT DOCUMENTS

| | | | |
|---|---|---|---|
| 3,448,233 | 6/1969 | Landis | 219/10.61 A |
| 3,810,058 | 5/1974 | White et al. | 336/60 |
| 3,936,784 | 2/1976 | Elfgen et al. | 336/197 |

*Primary Examiner*—Bruce A. Reynolds
*Assistant Examiner*—Clifford C. Shaw
*Attorney, Agent, or Firm*—John H. Shurtleff

[57] ABSTRACT

An improved means for mounting the induction coil of an inductively heated godet about the magnetic core thereof so as to eliminate any movement or play therebetween in operation caused by heat expansion and vibration. The improvement comprises placing an elastic intermediate piece between the coil and magnetic core which compensates for any unequal thermal expansion of these elements. In the preferred embodiment of the present invention, the intermediate piece is constructed of a hose-like hollow chamber through which a coolant under pressure is circulated from an external source.

2 Claims, 1 Drawing Figure

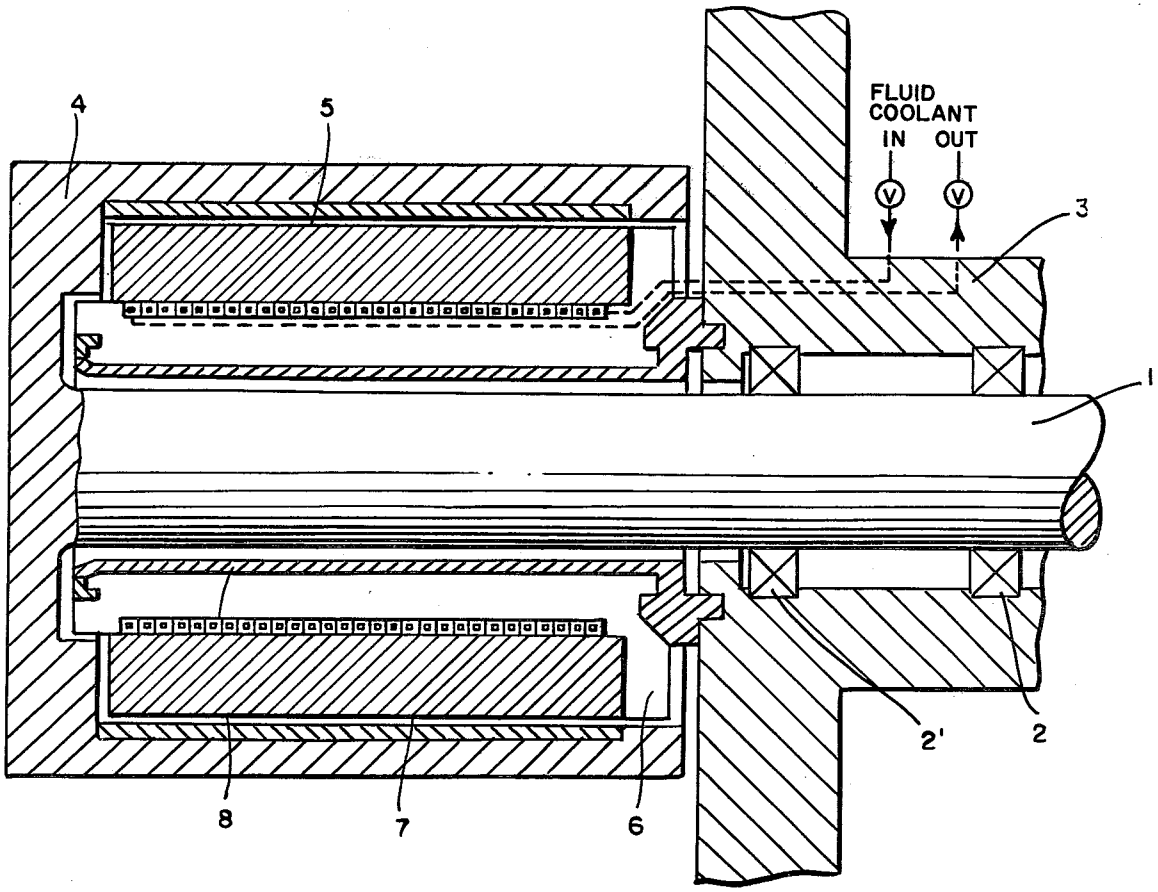
FLUID COOLANT
IN
OUT
1
2
2'
3
4
5
6
7
8

INDUCTIVELY HEATABLE GODET WITH INSULATING MEANS

INTRODUCTION

The present invention relates generally to an inductively heated godet of an improved design and, more particularly, to a means for mounting the induction coil of such a godet about the laminated pack of the magnetic core element so as to eliminate any movement or play therebetween in operation caused by heat expansion and vibration and to provide an insulation against overheating of the core and bearings of the rotatable godet.

BACKGROUND OF THE INVENTION

Inductively heated godets are widely used for guiding or conveying continuous synthetic fiber yarns and the like and are particularly useful in stretching and texturizing devices for the treatment and processing of such yarns. In operation, the yarns are generally wound several times about the outer circumference of the driven outer shell or casing of the godet and heat is thereby conducted to the yarn for the purpose of, for example, plastic deformation or fixation.

Godets of this general type are characterized by an induction coil being mounted in a stationary coaxial position about a laminated magnetic core which is rigidly connected to the frame of the device. A drive shaft extends coaxially through the center of the laminated pack and the rotatable casing which surrounds the induction coil and laminated pack assembly is secured to the end of this drive shaft. An example of such a godet is shown in U.S. Pat. No. 3,487,187 issued Dec. 30, 1969, the disclosure of which is incorporated herein by reference.

A significant problem encountered with such godets, however, has been the loosening of the induction coil from the iron core of the laminated pack in operation. This problem is caused by the differing coefficients of thermal expansion of the material used for the coil (e.g. tin, aluminum, or copper) and the material used for the laminated pack (e.g. iron). This problem is particularly acute at high operating speeds where the yarn is conveyed at speeds of 4,000 m/min. and more. At such speeds, slight vibrations created in the godet become significant and may result in an axial shift and wear of the coil.

BRIEF DESCRIPTION OF THE INVENTION

The present invention overcomes this problem found with the prior art inductively heated godets by providing a unique means for securing the induction coil of such godets about the magnetic core in such a manner that thermal expansion of these elements and vibration will not cause the coil to loosen during operation of the device.

The solution to this problem results from placing an elastic intermediate piece between the induction coil and the laminated pack which compensates for any unequal thermal expansion of these elements. In assembly, the coil is slipped onto the elastic intermediate piece which is positioned about the laminated pack and then is secured against axial shifting. As a result, the coil is sufficiently secured that, even when heat expansion of the elements occurs during operation of the device, without further compensating measures there is no longer any danger of damaging the coil. Furthermore, the elastic intermediate piece acts as an insulator thereby reducing the heating of the godet bearings due to heat loss through the coil and increasing the service life of these bearings.

Assembly and disassembly of the induction coil may be significantly simplified by providing an elastic intermediate piece that mat by externally expanded. This embodiment makes it possible to easily replace the coil without any danger of damaging any component parts for such purposes as, for example, changing the installed heating output. Constructing the intermediate piece as a hose-like hollow chamber that may be externally tensioned by means of compressed air is one method of advantageously achieving this purpose.

In another embodiment of the invention, the hose-like intermediate piece is connected to a coolant circuit which is under pressure. Thus, in this simple manner, the godet bearing is effectively protected against the deleterious effects of heat while at the same time the coil is reliably secured to the laminated pack during operation of the device.

DESCRIPTION OF THE DRAWING

The single illustration shows a schematic longitudinal section through an inductively heated godet constructed in accordance with an embodiment of the present invention.

DESCRIPTION OF THE PREFERRED EMBODIMENT

Referring to the drawing, in the preferred embodiment of the invention, godet drive shaft 1 rests in two ball bearing assemblies 2 and 2' mounted in the frame 3 of the machine. It is also possible to support godet drive shaft 1 in a bearing housing or godet ball which is secured to machine frame 3.

The end of godet shaft 1 within machine frame 3 is driven by a motor (not shown) and the other front, free end of the shaft carries godet casing 4 upon which synthetic fiber yarn may be wound. Mounted between rotatable casing 4 and drive shaft 1 are a coil 5 and laminated pack 6 which are firmly secured to a carrier 8 which is fixed on machine housing 3. The elastic intermediate piece 7 of the present invention is located between coil 5 and laminated pack 6. Coil 5 is supported solely by the elastic intermediate piece 7.

In mounting coil 5, which is supplied as a finished package, upon laminated pack 6, intermediate piece 7 is compressed and coil 5 is then pushed over it. The pressure on the intermediate piece is then relieved and it expands to secure the coil upon the laminated pack.

During operation of the godet, the coil and laminated pack will expand due to the inductive heating of the assembly. Since the coil and laminated pack are made of different materials, their expansion due to heating will also be different. Since the coil is solely supported upon laminated pack 6 by elastic intermediate piece 7, the intermediate piece will completely compensate for these differences in expansion so that the coil will continue to be secured to the laminated pack without play.

In a preferred embodiment of the present invention, the elastic intermediate piece 7 may be constructed of a hose-like hollow chamber rather than a solidly formed elastic body, the hose extending in the manner of a coiled heat exchanger around the laminated pack with an inlet and outlet end for fluid coolant extending back through the machine housing 3. In such an embodiment, the hose is expanded under pressure by filling it with a coolant in order to secure the coil about the laminated pack. The assembly is then connected to a coolant circuit so that circulation therethrough is maintained. A further advantage of such a construction is that the heat transfer to the godet drive shaft 1 is interrupted, or at least sharply restricted, thereby reducing the amount of heat carried to the shaft bearings 2 and 2'. This makes it possible to move bearing 2' outwardly toward the free end of the shaft thereby reducing the length of shaft projecting beyond said bearing. In this manner the godet assembly is made more resistant to vibration and the load demands on the bearings are also significantly reduced.

While several particular embodiments of the present invention have been shown and described, it should be understood that various obvious changes and modifications thereto may be made by those skilled in the art, and it is therefore intended in the following claims to include all such changes and modifications as may fall within the spirit and scope of this invention.

What is claimed is:

1. An improved inductively heated godet of the type wherein a drive shaft drives a rotatable hollow casing which is secured to the end of the drive shaft and a heating device is located between the drive shaft and casing on the machine frame, the heating device comprising an induction coil placed about a magnetic core formed by a laminated pack, the improvement comprising:

an elastic intermediate piece having a hose-like hollow chamber located between the laminated pack and said coil and extending over the length of said laminated pack, said hose being expandable when filled with a fluid coolant to secure said coil about said laminated pack; and inlet and outlet means to circulate a fluid coolant through the expandable hose under pressure.

2. An improved inductively heated godet as claimed in claim 1 wherein said hose is connected by its inlet and outlet ends to a pressurized coolant circuit.

* * * * *